US008173344B2

(12) United States Patent
Akiyama et al.

(10) Patent No.: US 8,173,344 B2
(45) Date of Patent: May 8, 2012

(54) ELECTROPHOTOGRAPHIC PHOTOSENSITIVE MEMBER AND ELECTROPHOTOGRAPHIC APPARATUS

(75) Inventors: Kazuyoshi Akiyama, Mishima (JP); Tomohito Ozawa, Mishima (JP); Yuu Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 12/504,270

(22) Filed: Jul. 16, 2009

(65) Prior Publication Data

US 2010/0021835 A1 Jan. 28, 2010

(30) Foreign Application Priority Data

Jul. 25, 2008 (JP) ..... 2008-191982

(51) Int. Cl.
*G03G 5/08* (2006.01)

(52) U.S. Cl. ..... 430/66; 430/67

(58) Field of Classification Search ..... 430/66, 430/67, 57.4; 399/159
See application file for complete search history.

(56) References Cited

U.S. PATENT DOCUMENTS 4,569,855 A 2/1986 Matsuda et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
4,798,776 A * 1/1989 Honda et al. ..... 430/31
5,455,138 A 10/1995 Okamura et al.
5,582,944 A 12/1996 Yamamura et al.
5,817,181 A 10/1998 Okamura et al.
2009/0175654 A1* 7/2009 Akiyama et al. ..... 399/159

FOREIGN PATENT DOCUMENTS

JP 6-83091 3/1994

OTHER PUBLICATIONS

Japanese Patent Office machine-assisted translation of JP 06-083091 (pub. Mar. 1994).*

* cited by examiner

*Primary Examiner* — Janis L Dote
(74) *Attorney, Agent, or Firm* — Fitzpatrick, Cella, Harper & Scinto

(57) ABSTRACT

The present invention provides an electrophotographic photosensitive member in which a photoconductive layer is an amorphous layer that contains a silicon atom as a main component, and a surface layer contains an aluminum atom, a zinc atom and an oxygen atom so as to satisfy Expression (1) and Expression (2):

$$3.0 \leqq 100\{y/(x+y)\} \leqq 7.0 \quad (1), \text{ and}$$

$$1.05 \leqq z/(1.50x+y) \leqq 1.20 \quad (2),$$

in Expression (1) and Expression (2), x represents atom % of the aluminum atom contained in the surface layer, y represents atom % of the zinc atom contained in the surface layer, and z represents atom % of the oxygen atom contained in the surface layer.

4 Claims, 3 Drawing Sheets

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member and an electrophotographic apparatus having the electrophotographic photosensitive member.

2. Description of the Related Art

An amorphous deposited film (amorphous-silicon-deposited film) which contains a silicon atom as a main component and further contains a hydrogen atom, a halogen atom and the like has high performance and high durability and causes no pollution when used as a photosensitive member of an electrophotographic photosensitive member to be used in an electrophotographic apparatus, and is commercially used. Electrophotographic photosensitive members having various layer structures with the use of such a deposited film are proposed so as to meet various requirements for the performance. Among them, the electrophotographic photosensitive member provided with a surface layer has superior abrasion resistance, charge retentivity and environment resistance, and is generally used.

Along with the development of the colorization of the electrophotographic apparatus, a finer image is formed, the image is exposed with rays having shorter wavelengths, and the surface layer having high transmissivity to the rays having the shorter wavelengths is required. A technology (Japanese Patent Application Laid-Open No. H06-83091) of forming the surface layer from an aluminum oxide material containing zinc is reported as a technology relating to the surface layer having a large band gap to rays having such shorter wavelengths.

Furthermore, when the processing speed of forming an image is increased according to the request of increasing a printing speed of the electrophotographic apparatus, the load for the electrophotographic photosensitive member increases, so that when the image is repeatedly formed with the use of a conventional electrophotographic photosensitive member at a high speed for a long period of time, various problems arise. Specifically, a part of the surface layer is lifted up from a photoconductive layer in a fine region with a diameter of approximately several micrometers, and as a result, the outline of the image occasionally spreads and becomes unclear to cause image blurring, or the abrasion amount of the surface layer occasionally suddenly increases during use. In addition, a so-called ghost may be produced, which is a phenomenon that an image pattern formed right before is formed and overlapped on the present image, or an image quality may be lowered due to a phenomenon that a toner having deposited on the surface of the electrophotographic photosensitive member is fusion-bonded with the surface. The electrophotographic photosensitive member with the use of the amorphous-silicon-deposited film originally forms a sharp latent image, so that the image blur and the ghost tend to outstand as the degradation of the image for the electrophotographic photosensitive member. From that point of view, the electrophotographic photosensitive member having the surface layer formed from the above described aluminum oxide material containing zinc is difficult to be applied to an electrophotographic apparatus which forms the image at the high speed.

SUMMARY OF THE INVENTION

An object of the present invention is to provide an electrophotographic photosensitive member which has a wide band gap to rays having short wavelengths, is provided with a surface layer superior in adhesiveness and abrasion resistance, and is thereby superior in durability. In other words, the object is to provide an electrophotographic photosensitive member which inhibits an image blur and a ghost originating in the peeling of the surface layer from the interface in the electrophotographic photosensitive member, the melt-adhesion of a toner with the electrophotographic photosensitive member and the abrasion of the surface layer, is suitable for an electrophotographic apparatus that forms a fine image at a high speed, and can extend the life of the electrophotographic apparatus. The object of the present invention is also to provide an electrophotographic photosensitive member which promotes an interaction between a photoconductive layer and the surface layer, and has enhanced light sensitivity.

The object of the present invention is also to provide an electrophotographic apparatus having the electrophotographic photosensitive member as is described above.

The present inventors made an extensive investigation on the electrophotographic photosensitive member so as to find out a surface layer which has high transmissivity to rays having short wavelengths and is superior in adhesiveness and abrasion resistance, and as a result, accomplished the present invention.

Specifically, the present invention provides an electrophotographic photosensitive member having a conductive substrate, and a photoconductive layer and a surface layer formed in this order on the conductive substrate, wherein the photoconductive layer is an amorphous layer which contains a silicon atom as a main component, and the surface layer contains an aluminum atom, a zinc atom and an oxygen atom so as to satisfy Expression (1) and Expression (2):

$$3.0 \leqq 100\{y/(x+y)\} \leqq 7.0 \quad (1), \text{ and}$$

$$1.05 \leqq z/(1.50x+y) \leqq 1.20 \quad (2).$$

In Expression (1) and Expression (2), x represents atom % of the aluminum atom contained in the surface layer, y represents atom % of the zinc atom contained in the surface layer, and z represents atom % of the oxygen atom contained in the surface layer.

The present invention also provides an electrophotographic apparatus having the above described electrophotographic photosensitive member.

The present invention can provide an electrophotographic photosensitive member which has a wide band gap to rays having short wavelengths, has a surface layer superior in adhesiveness and abrasion resistance, and thereby is superior in durability. In other words, the present invention can provide an electrophotographic photosensitive member which inhibits an image blur and a ghost originating in the peeling of the surface layer from the interface in the electrophotographic photosensitive member, the melt-adhesion of a toner with the electrophotographic photosensitive member and the abrasion of the surface layer, is suitable for an electrophotographic apparatus that forms a fine image at a high speed, and can extend the life of the electrophotographic apparatus. The present invention can also provide an electrophotographic photosensitive member which promotes an interaction between a photoconductive layer and the surface layer, and has enhanced light sensitivity.

The present invention can also provide an electrophotographic apparatus having the electrophotographic photosensitive member as is described above.

Further features of the present invention will become apparent from the following description of examples with reference to the attached drawings.

DESCRIPTION OF THE EMBODIMENTS

Figure 1:
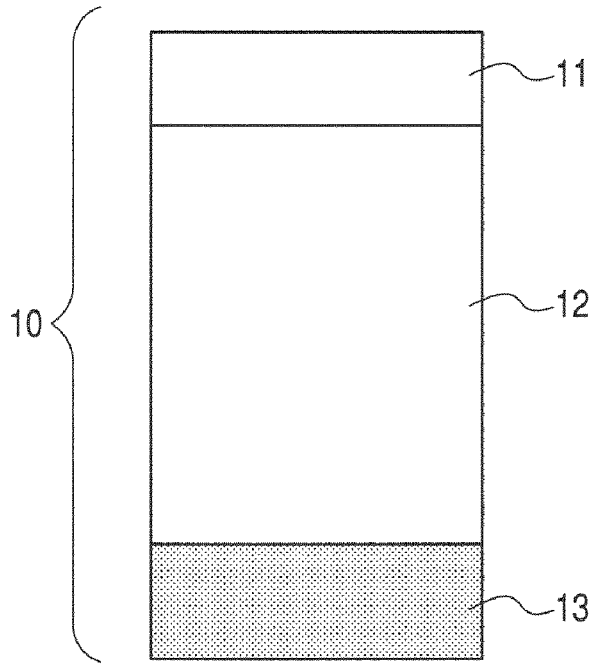
FIG. 1 is a block diagram illustrating one example of a layer structure of an electrophotographic photosensitive member according to the present invention.

The electrophotographic photosensitive member according to the present invention has a conductive substrate, and a photoconductive layer and a surface layer formed in this order on the conductive substrate.

(Conductive Substrate)

The conductive substrate to be used in an electrophotographic photosensitive member according to the present invention shall have a strength which can support a photoconductive layer and a surface layer to be provided on the conductive substrate. The material can include, for instance, a metal such as aluminum, chromium, molybdenum, gold, indium, niobium, technetium, vanadium, titanium, platinum, lead and iron, and an alloy containing these metals (aluminum alloy and stainless steel, for instance). The usable material also includes a synthetic resin such as polyester, polyethylene, polycarbonate, cellulose acetate, polypropylene, polyvinyl chloride, polystyrene and polyamide, glass and ceramic, of which the surface to have a photoconductive layer formed thereon is electroconductive-treated.

The above described conductive substrate can be worked into a cylindrical shape, or worked into a belt shape from the sheet.

(Photoconductive Layer)

A photoconductive layer according to the present invention is the one which shows a practicable photoconductivity as an electrophotographic photosensitive member, and is an amorphous layer (hereinafter referred to as "amorphous silicon layer" as well) which contains silicon atoms as a main component. The amorphous silicon layer has high hardness and stability. A photoconductive layer formed of the amorphous silicon layer hardly causes the peeling of a surface layer at the interface when being combined with the surface layer, even though having received a mechanical stress, and can enhance the durability of the electrophotographic photosensitive member.

In addition, when the surface layer is formed on the photoconductive layer even with the use of a vacuum process, the photoconductive layer causes little change in the layer due to degasification and can give little influence to the formation of the surface layer.

The above described photoconductive layer may contain hydrogen atoms and halogen atoms in addition to silicon atoms. These atoms are bonded with dangling bonds of the silicon atoms, and enhance a quality of the layer, particularly, the photoconductivity and charge retentivity. The total of the contents of the hydrogen atom and the halogen atom in the photoconductive layer can be 10 atom % or more and particularly 15 atom % or more with respect to the total content of the silicon atom, the hydrogen atom and the halogen atom, and can be 30 atom % or less and particularly 25 atom % or less.

The above described photoconductive layer can contain atoms which control conductivity, as needed. The atoms which control the conductivity may be contained in the photoconductive layer in a state of being uniformly distributed, or may be contained in a state of being ununiformly distributed, in which the concentration gradually changes in a thickness direction. The usable atom for controlling the conductivity can be an atom to be used as a so-called impurity in a semiconductor field. Specifically, the atom can include an atom which belongs to Group 13 of the Periodic Table (hereinafter abbreviated as "Group 13 atom") and an atom which belongs to Group 15 of the Periodic Table (hereinafter abbreviated as "Group 15 atom").

The Group 13 atom can include, for instance, boron, aluminum, gallium, indium and thallium. Among them, the Group 13 atom can particularly include boron, aluminum and gallium.

The Group 15 atom can include, for instance, phosphorus, arsenic, antimony and bismuth. Among them, the Group 15 atom can particularly include phosphorus and antimony.

The content of an atom which controls the conductivity can be $1\times10^{-2}$ atom ppm or more with respect to the silicon atom, particularly can be $5\times10^{-2}$ atom ppm or more, and further particularly can be $1\times10^{-1}$ atom ppm or more. On the other hand, the content of an atom which controls the conductivity can be $1\times10^{4}$ atom ppm or less, particularly can be $5\times10^{3}$ atom ppm or less, and further particularly can be $1\times10^{3}$ atom ppm or less.

The film thickness of the above described photoconductive layer can be 15 μm or more and particularly can be 20 μm or more, because desired electrophotographic properties are obtained at the film thickness and the film thickness is economical. On the other hand, the film thickness can be 60 μm or less, particularly can be 50 μm or less, and further particularly can be 40 μm or less. When the film thickness of the photoconductive layer is 15 μm or more, the photoconductive layer can inhibit the increase of the amount of an electric current flowing into a charging member and the deterioration of the charging member. When the film thickness of the photoconductive layer is 60 μm or less, an abnormal growth portion of the photoconductive layer can be inhibited from further growing, for instance, to 50 to 150 μm in a horizontal direction, and 5 to 20 μm in a height direction, when the photoconductive layer is formed in a form of a deposited film. Thereby, the member to be slid on the surface of the electrophotographic photosensitive member is inhibited from being damaged, a defect image is inhibited from being formed, and the durability of the electrophotographic apparatus can be enhanced.

Such a photoconductive layer may be formed into a single layer or into a structure having a plurality of layers, in which a charge-generating layer and a charge-transporting layer are separated.

The above described photoconductive layer can be formed with a deposition film-forming method such as a plasma CVD method, a vacuum vapor-deposition method, a sputtering method, an ion plating method. These deposition film-forming methods can be selected according to a manufacture condition, an investment load, a manufacture scale and required characteristics, but a plasma CVD method can be employed because of being capable of easily supplying a raw material.

The method for forming the photoconductive layer with the plasma CVD method can employ a high-frequency plasma CVD apparatus which will be described later. The outline of the method of forming the photoconductive layer with the plasma CVD method will now be described below.

A source gas for supplying a silicon atom, which can supply the silicon atom, and a source gas for supplying a hydrogen atom, which can supply the hydrogen atom, are introduced into a reaction vessel of which the inner part can be decompressed, in a desired gas state. At this time, a source gas for supplying a halogen atom, which can supply the halogen atom, and a source gas which can supply an atom for controlling the conductivity can be additionally introduced thereinto, as needed.

Next, the introduced source gas is decomposed, and the silicon atom is deposited and grown together with the hydrogen atom and other atoms on the conductive substrate which has been previously arranged at a predetermined position to form the photoconductive layer.

A gas of silanes such as silane ($SiH_4$) and disilane ($Si_2H_6$) can be used as the source gas for supplying the silicon atom. Hydrogen ($H_2$) gas can be also used as a source gas for supplying hydrogen atom in addition to the above described silanes. A source gas for supplying a halogen atom can include gases of a halogen compound such as $F_2$, BrF, ClF, $ClF_3$, $BrF_3$, $BrF_5$, $IF_3$ and $IF_7$ and a silicon compound containing a halogen atom such as $SiF_4$ and $Si_2F_6$.

A source gas for supplying the Group 13 atom and a source gas for supplying the Group 15 atom can employ a raw material which is gaseous at normal temperatures and pressures, or a raw material which can be easily gasified at least in a film-forming condition for the photoconductive layer.

The source gas for supplying the Group 13 atom can particularly include a gas of a compound of boron, aluminum and gallium. The source gas for supplying the Group 15 atom can particularly include a gas of a compound of phosphorus and antimony. Specifically, the source gases can include diborane ($B_2H_6$) and phosphine ($PH_3$).

These source gases can be used after having been diluted by a hydrogen gas, a helium gas and the like, as needed.

(Surface Layer)

The surface layer in the present invention contains an aluminum atom, a zinc atom and an oxygen atom in a range of satisfying Expression (1) and Expression (2).

$$3.0 \leqq 100\{y/(x+y)\} \leqq 7.0 \quad (1)$$

$$1.05 \leqq z/(1.50x+y) \leqq 1.20 \quad (2)$$

In Expression (1) and Expression (2), x represents the atom % of the aluminum atom contained in the surface layer, y represents the atom % of the zinc atom contained in the surface layer, and z represents the atom % of the oxygen atom contained in the surface layer.

The above described surface layer can contain the aluminum atom, the zinc atom and the oxygen atom as a main component atom, and can be formed as an amorphous deposited film.

Hereafter, 100{y/(x+y)} in Expression (1) will be expressed by Cy, as well.

The Cy is the ratio of the zinc atom with respect to the total of the aluminum atom and the zinc atom expressed by percentage. The reason why the value of the Cy is set in a range of 3.0 or more and 7.0 or less, in other words, in such a range as to satisfy Expression (1) will now be described below.

When the Cy is less than 3.0 and when the surface layer having such a ratio of the atoms is formed as a deposited film, the deposited film grows into a columnar shape almost similarly to the case of the aluminum oxide. Generally, when the deposited film is grown on a substrate, firstly, the deposit grows into an island shape while starting from a growth nucleus. The deposit grows into the columnar shape or into a film shape from such a growth nucleus, which depends on the selected composition and film-forming condition. The deposited film which grows from the growth nucleus into the film shape has few voids in between itself and the substrate, and has a uniform structure with high density. When such a deposited film is used as the surface layer, a stress is not concentrated and accumulated in the interface between the surface layer and the photoconductive layer, so that it is considered that the surface layer can be inhibited from being peeled off at the interface. On the other hand, in the case of a deposited film in which the deposit has grown into the columnar shape, many voids are seen in a portion at which the columnar structure is formed from the growth nucleus, and the deposited film has low density at the portion. For this reason, when the Cy is less than 3.0, the surface layer formed in a form of the deposited film has impaired adhesiveness between the surface layer and the photoconductive layer, and in addition, when being repeatedly subjected to a high-speed image-forming process, a stress due to the mechanical stress is accumulated in the interface. Therefore, one part of the surface layer is finely lifted up from the photoconductive layer, which inhibits the electric charge from passing in the lifted portion and causes an image blur. Particularly, the photoconductive layer of an amorphous silicon layer has high hardness, so that the stress tends to be easily accumulated in the interface between the photoconductive layer and the surface layer, and tends to promote the occurrence of the image blur. In addition, because the electric charge is inhibited from passing through the interface, the reproducibility of dots is impaired even though the part is so small as not to be recognized in letter image formation, and a gradation skip often occurs. Such a tendency is easier to become noticeable as the dot becomes smaller.

When the Cy is 3.0 or more and 7.0 or less, and when the surface layer having such a ratio of the atoms is formed as the deposited film, an increased amount of the zinc atom inhibits the aluminum oxide from growing into the columnar shape, and the deposited film grows into a film shape even on the photoconductive layer which is the amorphous silicon layer. For this reason, a formed deposited film acquires a uniform structure having high adhesiveness to the photoconductive layer. As a result, the deposited film inhibits the stress from being accumulated in the interface between the deposited film and the photoconductive layer even in use for a long period of time, inhibits itself from being finely lifted up, and accordingly can make an obtained image satisfactory. In addition, when the Cy is in this range, the deposited film keeps a resistance value of a range necessary for retaining an electric charge therein as the surface layer, due to the mixture of the aluminum oxide and the zinc oxide, and inhibits the generation of such a residual potential as to become a problem. This is considered to be because the aluminum oxide or the aluminum atom forms a donor level with respect to the zinc oxide.

When the Cy exceeds 7.0 and does not reach approximately 90 and when the electrophotographic photosensitive member having the surface layer formed of the deposited film having such a ratio of the atoms is repeatedly subjected to an image-forming operation, the surface layer shows a tendency of increasing the abrasive amount from a certain point on. The detailed reason why the abrasive amount increases does not become clear because the mechanical and chemical effects are complicated and intertwined with each other in a mechanism that the surface layer is abraded in an electrophotographic process, but the present inventors suppose the reason in the following way.

That is, it is considered that since the aluminum oxide and the zinc oxide have characteristics to be hardly mixed with each other, they are not uniformly mixed in a growth process of the deposited film in which some amounts of these oxides are contained respectively, and grow while forming a type of clusters respectively. It is considered that as a result, the formed film becomes mechanically unstable, causes some change in the film structure when the image is repeatedly formed for a long period of time, though having sufficient film hardness in an early period of time, and accordingly increases the abrasive amount. When the Cy is below approximately 20, the formed film keeps appropriate electroconductivity as the surface layer, and shows a low residual potential, but when the Cy exceeds approximately 20, an effect of forming a donor level gradually increases, the resistance is lowered, the formed film cannot appropriately keep an electric charge, and may cause the spread of a latent image and a consequent image blur. The image blur occurring in this case is different from that occurring in the case in which the Cy is less than 3.0 and the uplift of the surface of the electrophotographic photosensitive member is observed, and a fine uplift of a film of the surface layer is not observed, so that the cause can be detected.

When the Cy exceeds approximately 90, and when the surface layer having such a ratio of the atoms is formed as the deposited film, the surface layer grows into a uniform film shape substantially similar to that of the zinc oxide. For this reason, the surface layer decreases the abrasive amount due to a repetitive use, but remarkably forms the donor level, and further tends to cause the image blur due to its lowered resistance.

When the aluminum atom contained in the surface layer is represented by x atom %, the zinc atom contained in the surface layer is represented by y atom %, and the oxygen atom contained in the surface layer is represented by z atom %, the above described surface layer makes the value of $z/(1.50x+y)$ controlled to a range of 1.05 or more and 1.20 or less, in other words, satisfy Expression (2). In Expression (2), $z/(1.50x+y)$ represents a ratio of an oxygen atom actually contained in the surface layer with respect to an oxygen atom according to a stoichiometric theoretical value of the total of an oxygen atom in aluminum oxide ($Al_2O_3$) and an oxygen atom in zinc oxide (ZnO) contained in the surface layer. Hereafter, $z/(1.50x+y)$ in Expression (2) is expressed by Cz as well.

When the Cz is 0.95 or more and less than 1.05, the surface layer which contains oxygen atoms in the deposited film in such a ratio tends to form an oxygen atom deficiency. Generally, the oxygen atom deficiency in the zinc oxide forms the donor level due to the deficiency and increases the electroconductivity. However, when the surface layer contains the aluminum atom and the zinc atom in such a range as to satisfy Expression (1), and when the Cz is less than 1.05, the electroconductivity due to the oxygen atom deficiency cannot be increased. The reason is thought to be because the surface layer contains a little amount of the zinc atom, does not have an obvious energy band structure of the zinc oxide formed therein, and accordingly does not result in forming the donor level due to the oxygen atom deficiency. Besides, electric charges accumulate at a localized level due to the oxygen atom deficiency, which tends to generate a ghost.

When the Cz is 1.05 or more and 1.20 or less, the surface layer which contains in such a ratio of oxygen atoms in the deposited film hardly causes the oxygen atom deficiency. The aluminum oxide forms the donor level with respect to the zinc oxide as was described above, accordingly does not cause a residual potential and can effectively inhibit the generation of the ghost. The bond between an aluminum atom and a zinc atom can exist in the deposited film containing the aluminum atom, the zinc atom and an oxygen atom. For this reason, the content of an oxygen atom when the oxygen atom is contained in the surface layer without excess or deficiency is considered to be smaller than a theoretical value of the oxygen atom contained in the aluminum oxide and the zinc oxide, in other words, the Cz is considered to be less than 1. However, the surface layer shall contain the oxygen atom of 0.05 or more and 0.20 or less by a surplus atomicity with respect to a stoichiometrically theoretical value as was described above, and thereby can be given high adhesiveness and optical properties.

When the Cz exceeds 1.20 and when the image is repeatedly formed, the toner is easily fusion-bonded onto the electrophotographic photosensitive member. As the reason, the followings are considered.

When the Cz is in this range, the oxygen atom is extremely excessive with respect to the aluminum atom and the zinc atom, so that a surplus oxygen atom which is not bonded to other atoms exists in a free state. The oxygen atoms in such a free state are gradually emitted from the surface of the surface layer by receiving a mechanical action and an electrical action such as charging and discharging, which occur while the electrophotographic apparatus is used, and at this time, react with a component contained in a toner to change the toner. Then, the changed toner is considered to adhere to the surface of the electrophotographic photosensitive member.

In addition, when the Cz is in a range less than 0.95, the content of the oxygen atom with respect to the aluminum atom and the zinc atom is extremely smaller than the stoichiometric theoretical value, which tends to improve the ghost. This is because the resistance is lowered by a reduction of the energy band gap in the surface layer. However, such a surface layer increases the absorption of rays having short wavelengths, and is not applicable.

The values of the Cz and the Cy adopted in the present invention are obtained based on the following measurement values.

Specifically, a sample of the surface layer of the electrophotographic photosensitive member is prepared, which has been cut out into a size of approximately 12 mm×12 mm. This sample is arranged in an ESCA instrument (Quantum 2,000 Scanning ESCA: product made by PHI Corporation). The deposit on the surface in a range of 2 mm×2 mm is removed by sputtering at 4 kV for 5 minutes, then, the atoms of the aluminum atom, the zinc atom and the oxygen atom are measured, and a composition ratio (specifically x, y and z) is obtained. The Cy and the Cz are calculated from this value.

The thickness of the above described surface layer can be appropriately selected from the viewpoints of mechanical properties and electrical properties. The film thickness of the surface layer can be 0.1 μm or more and 3 μm or less from the viewpoint of imparting a protecting function to the surface layer and inhibiting the increase of the residual potential.

The above described surface layer can be formed with a method for forming a deposited film such as a plasma CVD method, a vacuum deposition method, a sputtering method and a laser ablation method. These methods for forming the deposited film can be selected based on a manufacture condition, an investment load, a manufacture scale, required characteristics and the like, but the sputtering method is optimal because a metal oxide film is easily formed. When the sputtering method is used, the composition of the obtained deposited film can be easily controlled by adjusting a ratio of the area of a target surface occupied by the aluminum atom and the zinc atom in the target, and using oxygen gas as a reactive gas. The deposited film having a desired composition can be also formed by using a mixture of the aluminum oxide and the zinc oxide as the target and introducing oxygen gas as needed. It is necessary to use a high-frequency power as an electric power to be supplied to the target, but when the deposited film is formed while introducing oxygen gas, the high-frequency power can be used because the electric discharge becomes stable.

(Intermediate Layer)

An electrophotographic photosensitive member of the present invention may have various functional layers in addition to the above described layers. One of the functional layers can include an intermediate layer having a function of enhancing light sensitivity provided in between a photoconductive layer and a surface layer.

When the surface layer is directly stacked on the photoconductive layer, the component atoms are mixed in the interface between the photoconductive layer and the surface layer, and a diffusion layer is occasionally formed which absorbs an image exposure light and lowers the light sensitivity of the electrophotographic photosensitive member.

The intermediate layer has a function of a barrier layer for inhibiting the diffusion of the aluminum atom to the amorphous silicon layer of the photoconductive layer to inhibit the formation of the diffusion layer.

The intermediate layer can include an amorphous layer which contains a silicon atom and a nitrogen atom as a main component (hereinafter referred to as "a-SiN layer"), or an amorphous layer which contains a silicon atom and a carbon atom as a main component (hereinafter referred to as "a-SiC layer"). The a-SiN layer and the a-SiC layer have higher chemical stability than the amorphous silicon layer, and can inhibit the diffusion of the aluminum atom and the like contained in the surface layer. The composition ratios of these intermediate layers can be appropriately adjusted. When the a-SiN layer is employed, the content of the nitrogen atom with respect to the silicon atom can be in a range of 10 atom % or more and 55 atom % or less. In addition, when the a-SiC layer is employed, the content of the carbon atom with respect to the silicon atom can be in a range of 10 atom % or more and 100 atom % or less.

The above described intermediate layer may contain a substance which controls conductivity. Specifically, an atom to be used for controlling the conductivity can be a similar atom to the atom which is used for controlling the conductivity in the above described photoconductive layer.

A method for forming the above described intermediate layer can specifically include the same method as that for forming the photoconductive layer, can be a plasma CVD method because of being capable of easily supplying a raw material, and can be the same method as that for forming the photoconductive layer so as to be capable of continuously manufacturing the photoconductive layer.

The above described intermediate layer can include at least one compound selected from the group consisting of a metal oxide, a metal nitride and a metal fluoride, which do not contain an aluminum atom. Generally, a metal oxide, a metal nitride and a metal fluoride have a strong bonding force, have high chemical stability, and accordingly adequately function as the barrier layer when having been formed on the photoconductive layer. As a result, the metal compound can effectively inhibit the aluminum atom in the surface layer from diffusing to the photoconductive layer, as long as these compounds do not contain the aluminum atom. Such a compound can specifically include a magnesium oxide, a titanium oxide, a zinc oxide, a barium oxide, a magnesium fluoride, a lanthanum fluoride and a barium fluoride. These compounds can be employed in combination with one or more of the others.

A method to be used for forming such an intermediate layer can be specifically a similar method to the method which is illustrated as a method for forming the above described surface layer, and can be particularly a sputtering method. When the intermediate layer is formed with the sputtering method, a target which can supply an aimed metal atom is employed, and oxygen gas, nitrogen gas and fluorine gas selected as needed are introduced as reactive gases.

The above described intermediate layer contributes to the enhancement of the light sensitivity of the electrophotographic photosensitive member, can form an image in a wider processing condition, and can cope with a higher-speed image forming condition of the future.

(Electric-Charge Injection Preventing Layer)

An electric-charge injection preventing layer (lower electric-charge injection preventing layer or upper electric-charge injection preventing layer, for instance) can be provided in between a conductive substrate and a photoconductive layer or on the photoconductive layer, as one of the above described functional layers. These electric-charge injection preventing layers can contain a similar material to that in the photoconductive layer as a main component. Specifically, the electric-charge injection preventing layer can include a layer which contains a dopant such as a Group 13 element and a Group 15 element, in a matrix of an amorphous silicon of which the dangling bonds are terminated by hydrogen atoms and/or halogen atoms. The migration of a carrier to the photoconductive layer can be inhibited by providing such a layer having conductivity as the upper layer or the lower layer of the photoconductive layer. The adhesiveness of the photoconductive layer can be also enhanced by making the lower electric-charge injection preventing layer contain at least one type of an atom selected from the group consisting of a carbon atom, a nitrogen atom and an oxygen atom, as needed. It is also possible to make the intermediate layer contain a substance which controls the conductivity and have a function for preventing electric-charge injection as well, without separately providing an upper electric-charge injection preventing layer.

(Electrophotographic Photosensitive Member)

Figure 2:
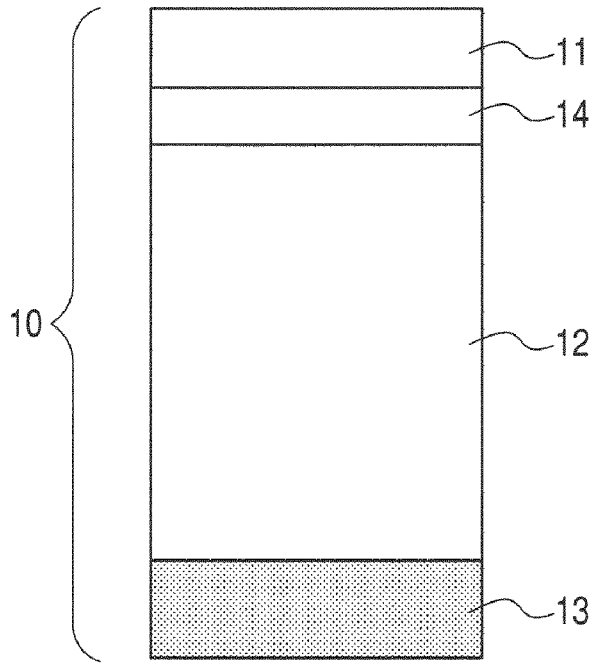
FIG. 2 is a block diagram illustrating another example of a layer structure of an electrophotographic photosensitive member according to the present invention.
Figure 3:
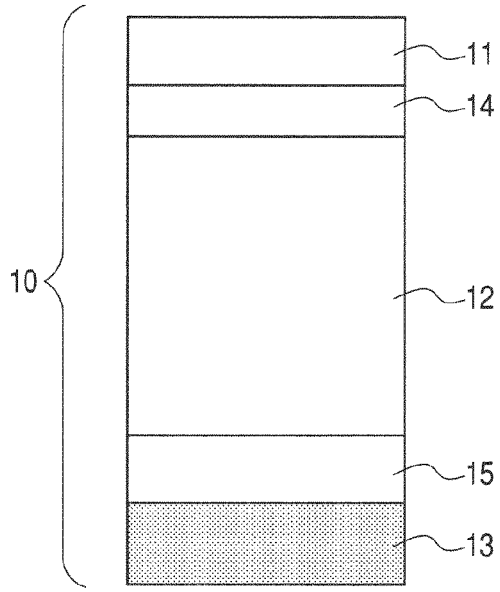
FIG. 3 is a block diagram illustrating another example of a layer structure of an electrophotographic photosensitive member according to the present invention.

The electrophotographic photosensitive member according to the present invention can include structures illustrated in FIG. 1 to FIG. 3. The electrophotographic photosensitive member includes an electrophotographic photosensitive member 10 (FIG. 1) having a photoconductive layer 12 and a surface layer 11 formed in this order on a conductive substrate 13, an electrophotographic photosensitive member 10 (FIG. 2) further having an intermediate layer 14 provided in between the photoconductive layer 12 and the surface layer 11, and an electrophotographic photosensitive member 10 (FIG. 3) further having a lower electric-charge injection preventing layer 15 provided in between the conductive substrate 13 and the photoconductive layer 12.

(Manufacturing Apparatus)

One example of a method for manufacturing the electrophotographic photosensitive member according to the present invention will now be specifically described while illustrating manufacturing apparatuses to be used.

At first, a method with the use of a high-frequency plasma CVD apparatus illustrated in a schematic block diagram of FIG. 4 will now be described as one example of a method for forming the photoconductive layer.

Figure 4:
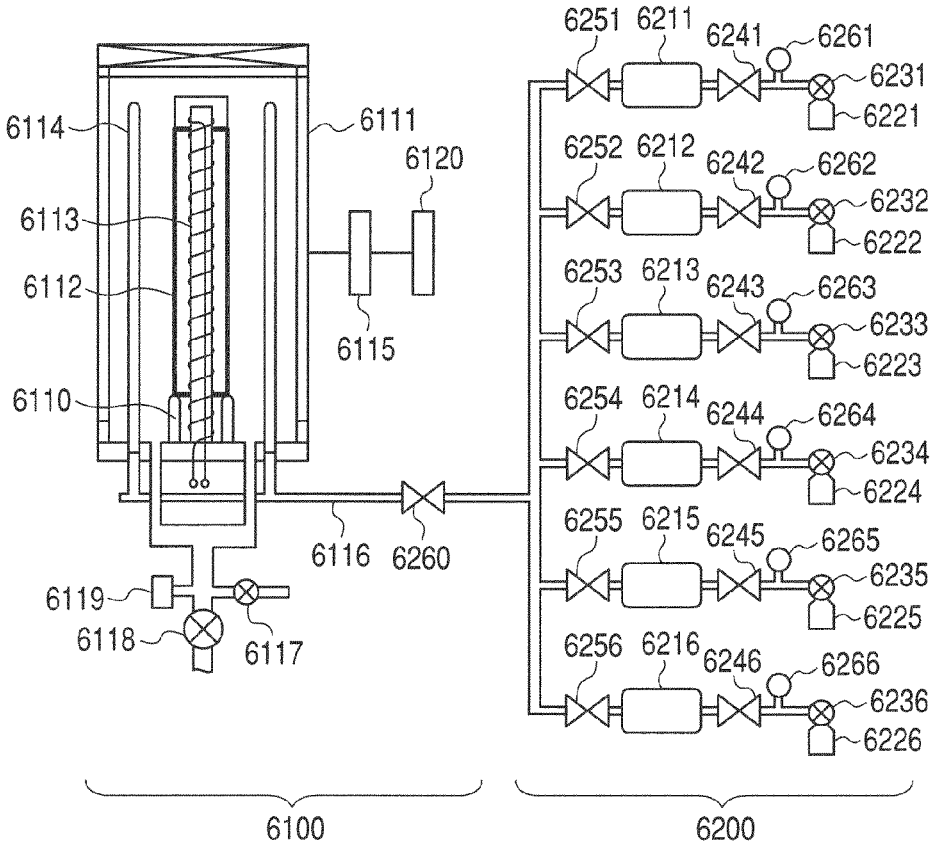
FIG. 4 is a schematic block diagram illustrating one example of a plasma CVD apparatus to be used in the manufacture of an electrophotographic photosensitive member according to the present invention.

The high-frequency plasma CVD apparatus as illustrated in FIG. 4 is mainly constituted by a deposition device 6100 having a reaction vessel 6111, a source gas supply device 6200 and an exhaust for decompressing the inside of the reaction vessel 6111.

A mounting table 6110 which mounts a cylindrical conductive substrate 6112 in the periphery of an anode, a heater 6113 for heating the conductive substrate, and a source gas introduction pipe 6114 are provided in the reaction vessel 6111 provided in the deposition device 6100. A high-frequency power source 6120 is connected to the reaction vessel 6111 which serves as a cathode, through a high-frequency matching box 6115.

The exhaust has a vacuum pump (not shown) which is connected to the reaction vessel 6111 through an exhaust valve 6118 and forms a desired decompressed state in the reaction vessel, a vacuum gauge 6119 which measures an atmospheric pressure in the reaction vessel, and a leak valve 6117 which releases the vacuum, provided therein.

The source gas supply device 6200 is constituted by bombs of source gases 6221 to 6226, valves 6231 to 6236, 6241 to 6246 and 6251 to 6256, pressure controllers 6261 to 6266, and mass flow controllers 6211 to 6216. The source gas supply device 6200 is connected to the source gas introduction pipe 6114 in the reaction vessel 6111 through a valve 6260 and pipe 6116.

A photoconductive layer is formed with the use of this high-frequency plasma CVD apparatus and according to such a procedure, for instance, as will be described below.

A conductive substrate 6112 is mounted on a mounting table 6110 in a reaction vessel 6111, an exhaust is operated, and the inside of the reaction vessel 6111 is exhausted. Then, a conductive substrate 6112 is controlled to a predetermined temperature of 200 to 350° C. by a heater 6113 for heating the conductive substrate. Subsequently, a source gas stored in a bomb of a source gas is introduced into the reaction vessel 6111 from a gas supply device 6200, while the flow rate is controlled. An operator operates an exhaust valve 6118 to adjust the pressure in the reaction vessel 6111 to a predetermined pressure, while watching the display of a vacuum gauge 6119. When the pressure becomes stable, a high-frequency power with a high-frequency, for instance, of 1 MHz to 30 MHz in an RF zone is supplied to a reaction vessel of an electrode through a high-frequency matching box 6115 from a high-frequency power source 6120 to generate a glow discharge. This discharge energy decomposes the source gas which has been introduced into the reaction vessel 6111, makes a silicon atom or the like deposited on the conductive substrate 6112, and makes an amorphous deposited film formed which contains a silicon atom as a main component. After a film with a desired thickness has been formed, the supply of the high-frequency power is stopped, the valve of the gas supply device is closed, the supply of the source gas is stopped, and the formation of the deposited film is finished.

When forming a photoconductive layer having a multilayer structure or continuously forming an electric-charge injection preventing layer, the above described operation may be repeated after having adjusted a type and an amount of a source gas to be supplied to the reaction vessel, through a valve operation. It is also effective to rotate a mounting table at a predetermined speed so as to form a uniform deposited film.

After the formation of all the deposited films have been finished, a main valve 6118 is closed, a leak valve 6117 is opened, the pressure of the inside of the reaction vessel 6111 is returned to atmospheric pressure, and then the conductive substrate 6112 having the photoconductive layer formed thereon is taken out.

Next, a method with the use of a sputtering apparatus illustrated in a schematic block diagram of FIG. 5 will now be described which is one example of methods for manufacturing a surface layer.

Figure 5:
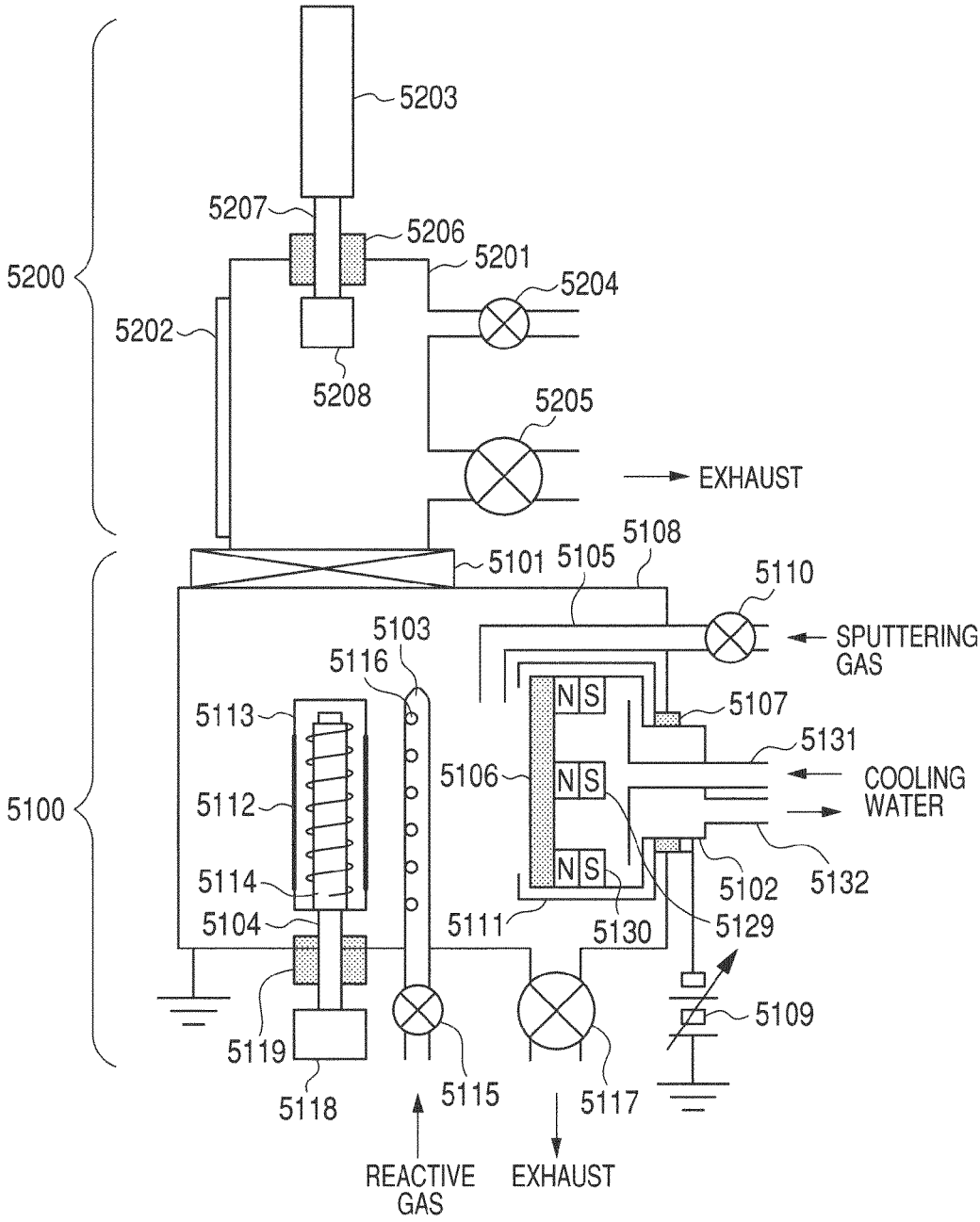
FIG. 5 is a schematic block diagram illustrating one example of a sputtering apparatus to be used in the manufacture of an electrophotographic photosensitive member according to the present invention.

The sputtering apparatus illustrated in FIG. 5 is mainly constituted by a reactor 5100 and a charger 5200. The reactor 5100 has a reaction vessel 5108 provided therein. The reaction vessel has a reactive gas nozzle 5103, a holder 5113 for mounting a conductive substrate 5112 thereon which has a photoconductive layer formed thereon, a sputtering gas introduction pipe 5105, a cathode 5102 and the like, provided therein. The reaction vessel 5108 is connected to an exhaust (not shown) through a valve 5117, so that a vacuum degree of the inner part can be controlled to a desired state. The holder 5113 is connected to a rotary shaft 5104 of a motor 5118 which is provided in the outside of a reaction apparatus. The rotary shaft 5104 is provided in the reaction vessel and is hermetically sealed by a rotary shaft seal 5119. A heater 5114 is installed in the holder 5113 so as to be capable of heating the conductive substrate 5112 to be mounted to a desired temperature. The reactive gas nozzle 5103 is provided so as to oppose to the holder 5113, and supplies a reactive gas such as oxygen gas into the reaction vessel through a gas discharge hole 5116 from a source gas supply device (not shown) which is connected to the reaction vessel through a valve 5115. A source gas supply device similar to the source gas supply device 6200 illustrated in FIG. 4 can be used for the sputtering apparatus. The cathode 5102 is supported by the reaction vessel 5108 through an insulating member 5107, and the periphery thereof has a shield 5111 provided thereon so as not to be sputtered. In addition, the cathode is connected with pipes 5131 and 5132 for circulating cooling water for cooling the cathode 5102 which is heated in a sputtering process, and is also connected with a power source 5109. A target 5106 has a structure of fitting a block therein in which a substance to be sputtered is stored. An area ratio of blocks in which aluminum oxide and zinc oxide, for instance, are stored respectively is controlled so as to correspond to a content ratio in the deposited film to be formed. Magnets 5129 and 5130 are arranged on the target 5106. The arrangement is appropriately adjusted so that the length of the magnets correspond to the length of the conductive substrate 5112 on a mounting table 5113, and the formed film can be thereby uniform in a generatrix direction of the conductive substrate 5112. A sputtering gas introduction pipe 5105 is arranged in the vicinity of the cathode 5102, and introduces a sputtering gas such as argon through a valve 5110.

The charger 5200 has a vacuum vessel 5201 which is communicated to the reaction vessel 5108 through a gate valve 5101, an actuator 5203 and the like, provided therein. An exhaust is connected to the vacuum vessel 5201 through a valve 5205, and forms a vacuum state independently of a reaction vessel 5108. A shaft 5207 of the actuator 5203 is supported by the vacuum vessel 5201 with the use of a vacuum seal 5206, and has a chucking mechanism 5208 which can hold the conductive substrate 5112, provided on its head.

The procedure of forming a surface layer with the use of this sputtering apparatus will now be specifically described below.

At first, a gate valve 5101 is closed, a valve 5117 is opened, and the inside of a reaction vessel 5108 is exhausted by an exhaust. At the same time, a conductive substrate 5112 having a photoconductive layer formed thereon is charged through a door 5202 into a charger 5200, and is set on a chucking mechanism 5208. Subsequently, the door 5202 is closed, a valve 5205 is opened, and the inside of the charger 5200 is exhausted. When the inside of both the reaction vessel 5108 and the charger 5200 has reached a vacuum degree, for instance, of 0.1 Pa or less, the gate valve 5101 is opened, a shaft 5207 is extended by being driven by an actuator 5203, and the conductive substrate 5112 is mounted on a holder 5113 in the reaction vessel 5108. Afterwards, the conductive substrate 5112 is released from the retention by the chucking mechanism 5208, the shaft 5207 is shortened, the chucking mechanism 5208 is accommodated in the charger 5200, and the gate valve 5101 is closed. In this state, the conductive substrate 5112 can be heated to a desired temperature by an energized heater 5114, as needed. When the conductive substrate 5112 has reached a desired temperature, a sputtering gas such as argon and a reactive gas are supplied into the reaction vessel 5108 respectively through valves 5110 and 5115 which have been opened. When a vacuum gauge (not shown) connected to the reaction vessel 5108 has indicated a predetermined pressure, a power source 5109 is applied to a cathode 5102 to generate a glow discharge in between the reaction vessel of an anode and the cathode. The sputtering gas is ionized by the glow discharge, and the ionized sputtering gas is collided with a target. The atom which has been sputtered from the target is reacted with the reactive gas, and aluminum oxide and zinc oxide are deposited on the conductive substrate 5112. A rotary shaft 5104 of a mounting table for mounting the conductive substrate 5112 thereon is rotated by a motor 5118, and a deposited film can be formed so as to have a uniform thickness in the peripheral direction of the conductive substrate 5112. When a desired deposited film is formed, the supply of an electric power from the power source 5109 is stopped, and the formation of the deposited film is finished. In order to form a surface layer having a plurality of regions, conditions such as a desired gas, a pressure and a substrate temperature are set again, and then an electric power may be applied to the cathode 5102 again to generate the glow discharge. The valves 5110 and 5115 are closed, the supply of the reactive gas and the sputtering gas is stopped, the energization to the heater 5114 is stopped, the inside in the reaction vessel 5108 is exhausted, for instance, to 0.1 Pa or less, and the gate valve 5101 is opened. The actuator 5203 is driven to extend the shaft 5207, the conductive substrate 5112 is held by the chucking mechanism 5208, the shaft 5207 is shortened again, and the gate valve 5101 is closed when the conductive substrate 5112 has been accommodated in the charger 5200. After it has been confirmed that the gate valve 5101 is closed, a valve 5204 is opened, the inside of a vacuum vessel 5201 is vented, the door 5202 is opened, the conductive substrate 5112 is taken out, and the formation of the electrophotographic photosensitive member is finished. In the above described method for manufacturing the electrophotographic photosensitive member, the conductive substrate 5112 on which the photoconductive layer has been formed with the use of the plasma CVD apparatus was taken out to the atmosphere, and was charged to the sputtering apparatus, but the conductive substrate 5112 may be transferred in a vacuum by installing a transport device which connects both apparatuses with each other and can transport the conductive substrate in a vacuum.

Examples 1 to 3 and Comparative Examples 1 to 4

A used conductive substrate (hereinafter referred to merely as "substrate") was a cylinder which was made from aluminum, had a outer diameter of 84 mm, a length of 381 mm and a wall thickness of 3 mm, and had the surface mirror-finished. An electrophotographic photosensitive member was produced by forming a photoconductive layer and a surface layer thereon.

The photoconductive layer was formed with the use of the plasma CVD apparatus illustrated in FIG. 4, in the condition shown in Table 1. The power source used a frequency of 13.56 MHz.

TABLE 1

| | Photoconductive layer |
|---|---|
| Flow rate of gas | |
| $SiH_4$ [ml/min (normal)] | 100 |
| $B_2H_6$ (ppm) (with respect to $SiH_4$) | 2.5 |
| $CH_4$ [ml/min (normal)] | 5 |
| Pressure [Pa] | 50 |
| High-frequency power [w] | 600 |
| Substrate temperature [° C.] | 210 |
| Film thickness [μm] | 28 |

The surface layer was formed as a deposited film which includes aluminum oxide and zinc oxide, by using the sputtering apparatus as illustrated in FIG. 5. Blocks formed from aluminum oxide and zinc oxide respectively (each having stoichiometric composition) were employed for a target and a ratio of aluminum to zinc in the deposited film was changed by changing the area ratio of the blocks. In addition, oxygen gas was used as a reactive gas, and an oxygen content in the deposited film was adjusted so as to be almost constant. The forming conditions of the surface layers are shown in Table 2 and Table 3.

TABLE 2

| | Surface layer |
|---|---|
| Target (area ratio of AlO:ZnO) | Table 3 |
| Flow rate of gas | |
| Ar [ml/min (normal)] | 150 |
| $O_2$ [ml/min (normal)] | Table 3 |
| Pressure [Pa] | 0.5 |
| Electric power [w] | 1500 |
| Substrate temperature [° C.] | 100 |
| Film thickness [μm] | 0.8 |

TABLE 3

| | Sample 1 Comparative example 1 | Sample 2 Example 1 | Sample 3 Example 2 | Sample 4 Example 3 | Sample 5 Comparative example 2 | Sample 6 Comparative example 3 | Sample 7 Comparative example 4 |
|---|---|---|---|---|---|---|---|
| Area ratio of AlO:ZnO | 10.0 | 12.5 | 19.0 | 23.5 | 24.5 | 46.0 | 80.0 |
| $O_2$ [ml/min (normal)] | 2.3 | 2.3 | 2.3 | 2.5 | 2.5 | 3.2 | 4.5 |
| Cy | 2.4 | 3.0 | 5.1 | 6.8 | 7.3 | 46.1 | 92.3 |
| Cz | 1.09 | 1.10 | 1.08 | 1.10 | 1.08 | 1.09 | 1.11 |

In the tables, the value of an area ratio of AlO:ZnO represents an area of zinc oxide block with respect to the whole area of the target. As for Cy and Cz, a sample was cut from the electrophotographic photosensitive members formed in the same condition, an influence of the deposit on the surface in a range of 2 mm×2 mm was removed by sputtering at 4 kV for 5 minutes, and an aluminum atom, a zinc atom and an oxygen atom were measured with ESCA. A composition ratio among the aluminum atom, the zinc atom and the oxygen atom (in other words, x, y and z) was determined based on the measured values, and was calculated therefrom.

Each of samples 1 to 7 (electrophotographic photosensitive members) which were prepared in this way was mounted on an electrophotographic apparatus (remodeled machine of electrophotographic apparatus iRC6800N: made by Canon Inc., which will be referred to merely as "remodeled machine" as well, hereinafter), an image was formed, and a chargeability, light sensitivity, a residual potential and a ghost of the electrophotographic photosensitive member were evaluated. The results are shown in Table 4.

The remodeled machine is specifically a machine in which a magnet roller that is a member of a cleaning roller in iRC6800N was changed to a sponge roller made from urethane rubber. The sponge roller abuts on the electrophotographic photosensitive member so as to form a nip width of 5 mm, and rotates in a forward direction at a peripheral difference of 120% with respect to a rotation speed of the electrophotographic photosensitive member. The machine was remodeled so as to use a laser beam source having an oscillation wavelength of 405 nm in an image exposure system of iRC6800N, and process an image at a resolution of 1,200 dpi.

(Chargeability)

A chargeability was measured by intercepting an image exposure light (laser beam) of a remodeled machine, and carried out corona charging for an electrophotographic photosensitive member by applying a high voltage of +6 kV to an electrifier. The surface potential (in other words, charging potential of dark portion) of the electrophotographic photosensitive member was measured by a sensor of a surface electrometer (Model 334 made by TREK, INC.) arranged in a position corresponding to a developing device, and the measured value was determined to be the chargeability of the electrophotographic photosensitive member.

(Light Sensitivity)

A charging current to be applied to an electrifier was adjusted so that a charging potential of a dark portion in an electrophotographic photosensitive member could be 450 V at a position of a developing device in a remodeled machine. The electrophotographic photosensitive member was irradiated with an image exposure light (laser beam) in a state of maintaining this charging current, and the intensity of the image exposure light was adjusted so that a surface potential of a light portion of the electrophotographic photosensitive member could be 50 V at the position of the developing device. The intensity of the image exposure light was determined to be a light sensitivity of the electrophotographic photosensitive member.

(Residual Potential)

Similarly to the method for measuring the light sensitivity, a charging current was adjusted so that a surface potential of a dark portion in the electrophotographic photosensitive member could be 450 V at the position of a developing device. Then, the electrophotographic photosensitive member was irradiated with an image exposure light having an intensity of 1.2 $\mu J/cm^2$, a surface potential of a light portion was measured, and this potential was determined to be a residual potential of the electrophotographic photosensitive member.

(Ghost)

Similarly to a method for measuring the light sensitivity, a charging current was adjusted so that a charging potential of a dark portion in an electrophotographic photosensitive member could be 450 V at the position of a developing device. Then, a draft was prepared which had a black circle with a reflection density of 1.3 and a diameter of 5 mm affixed on an end of a half tone document with a reflection density of 0.7, the draft was mounted on the document glass, and the copy image was formed. The difference of the reflection densities was measured between a ghost portion which was recognized on the obtained half tone image and was formed by the black circle with the diameter of 5 mm and the half tone portion. The reflection density was measured with the use of a reflection densitometer (504 spectral densitometry: product made by X-Rite Incorporated). The smaller is the numeric value, the more excellent is the ghost.

After the above described initial evaluation was carried out, a testing chart on which hiragana letters of 6 point were written on the whole surface was placed on the document glass, and a durability test was carried out which was a test of repeatedly forming images on 1,000,000 sheets of A4 copy paper in the environment of a temperature of 25° C. and a relative humidity of 50%. After the durability test, an image blur, an abrasion amount and melt-adhesion were evaluated. The image was evaluated by using a black-and-white image with the use of only black-developing device, as an output image.

(Image Blur)

A gradation data was prepared in which the whole gradation range was equally divided into 17 steps according to an area gradation by an image exposure light (in other words, area gradation of dot portions to be used in exposing image), and the image of the gradation data was output on an A3 copy paper by using a text mode of the above described electrophotographic apparatus. The image density of the obtained image was measured in each gradation with the use of the above described reflection densitometry. A correlation coefficient between the measured value and the gradation step was calculated, and the difference between the calculated correlation coefficient and a correlation coefficient to be obtained when a linear gradation is perfectly reproduced, which is 1.00, was evaluated as an image blur. In the evaluation, three sheets of images which had been output in the same condition were used, and the average of the measured values for the density in each gradation in the three sheets was used as an object. The smaller is a numeric value, the smaller is the image blur, and the more excellent is the gradation expressiveness.

(Abrasion Amount)

The spectral measurement of a reflected light was carried out by vertically irradiating the surface of an electrophotographic photosensitive member with a light having a spot diameter of approximately 2 mm, and with the use of a spectrometer (MCPD-2000: product made by OTSUKA ELECTORONICS CO., LTD.). The film thickness of the surface layer was calculated based on the interference waveform of the obtained reflected light. At this time, the film thickness was calculated on the assumption that the index of refraction of the photoconductive layer was 3.30, and the index of refraction of the surface layer was 1.90. The spectral was measured on three points (positions of 50 mm distant from each end of electrophotographic photosensitive member and central position) on the surface of the electrophotographic photosensitive member, and the average value was used as an object of the evaluation. The film thickness was measured three times of a time before a durability test, a time after having fed 500,000 sheets of paper in the durability test and further a time after the durability test, and the abrasion amount was evaluated according to a difference between the film thickness before the durability test and the film thickness after the durability test.

(Melt-Adhesion)

During the durability test, a white image (so-called solid white image) obtained by exposing the whole surface with a light was output on an A3 copy sheet every time after 50,000 sheets of paper were fed. The presence or absence of a black point on the obtained white image was visually checked. When the black point was visually identified, an electrophotographic photosensitive member was taken out from a remodeled machine, the surface thereof was observed with the use of a microscope, and the presence or absence of the melt-adhesion of a toner was determined. When it was determined that the toner was fusion-bonded, 10 sheets of images were sampled every time after 2,500 sheets were printed out in the durability test, the change of the state of the black spot was observed, and the images were evaluated according to the following criteria.

A: Melt-adhesion of a toner is not confirmed in the durability test.

B: Melt-adhesion which would not likely to give influence on character recognition occurs only one time in the durability test, but disappears in the durability test.

C: Melt-adhesion which would not likely to give influence on character recognition occurs two or three times in the durability test, but disappears in the durability test.

D: The test result matches with any of the following criteria D1 to D3.

D1: Melt-adhesion which has occurred once does not disappear in the durability test.

D2: Melt-adhesion which would not likely to give influence on the character recognition occurs four or more times.

D3: Melt-adhesion which is likely to make a character misread occurs.

TABLE 4

| | Sample 1 Comparative example 1 | Sample 2 Example 1 | Sample 3 Example 2 | Sample 4 Example 3 | Sample 5 Comparative example 2 | Sample 6 Comparative example 3 | Sample 7 Comparative example 4 |
|---|---|---|---|---|---|---|---|
| Cy | 2.4 | 3.0 | 5.1 | 6.8 | 7.3 | 46.1 | 92.3 |
| Chargeability | 1.03 | 0.98 | 1.00 | 0.98 | 1.05 | 0.96 | 0.98 |
| Light sensitivity | 0.98 | 1.02 | 1.00 | 0.97 | 0.98 | 1.03 | 1.03 |
| Residual potential | 1.36 | 1.18 | 1.00 | 1.20 | 0.93 | 1.24 | 0.94 |
| Ghost | 1.28 | 1.34 | 1.00 | 0.86 | 1.29 | 1.06 | 1.00 |
| Image blur | 2.32 | 1.09 | 1.00 | 1.48 | 0.96 | 2.36 | 4.38 |
| Abrasion amount (500,000 sheets) | 1.05 | 0.95 | 1.00 | 0.95 | 1.05 | 1.00 | 1.05 |
| Abrasion amount (1,000,000 sheets) | 0.97 | 0.95 | 1.00 | 1.18 | 1.68 | 2.46 | 1.42 |
| Melt-adhesion | A | A | A | A | A | A | A |

In the table, values of a chargeability, light sensitivity, a residual potential, an image blur, a ghost, an abrasion amount (500,000 sheets) and an abrasion amount (1,000,000 sheets) are expressed by relative values based on the assumption of considering respective values in Example 2 as 1.00. As for the chargeability, the larger is the numeric value, the more excellent is the chargeability. Particularly, when the numeric value is 0.90 or more, it can be said that an electrophotographic photosensitive member has adequate characteristics. As for the light sensitivity, the smaller the numeric value, the more excellent is the light sensitivity. Particularly, when the numeric value is 1.10 or less, it can be said that the electrophotographic photosensitive member can be adapted to a wide variety of process conditions and has adequate characteristics. As for the residual potential, the smaller the numeric value, the more excellent is the residual potential. Particularly, when the numeric value is 3.00 or less, it can be said that the electrophotographic photosensitive member can be adapted to a wide variety of process conditions and has adequate characteristics. When the image blur is 2.00 or less, the electrophotographic photosensitive member shows adequate gradation properties, and forms an adequate image almost without causing a recognizable color skip even when a color image is formed. When the ghost is 2.50 or less, it can be said that the image output from a practical machine shows such adequate characteristics as not to almost cause recognizable color irregularity. When the abrasion amount is 1.40 or less after 1,000,000 sheets of paper have been fed, the electrophotographic photosensitive member is assumed to sufficiently cope with the durability to be required in POD or the like.

It is understood that the image blur of a sample 1 (Comparative example 1) having a Cy of less than 3.0 is aggravated. As a result of having observed the surface of this electrophotographic photosensitive member through a microscope, a fine uplift of a surface layer was observed. The image blur is aggravated also in a sample 6 (Comparative example 3) and a sample 7 (Comparative example 4). This image blur is considered to be affected by lowered resistance in a deposited film. In samples having the Cy of 3.0 or more, the fine uplift of the surface layer was not observed even when observed through a microscope. It is determined from this result that the fine uplift of the surface layer can be inhibited as long as the Cy is kept at 3.0 or more.

In addition, it is understood that a sample 5 (Comparative example 2) having the Cy of 7.3 showed the same abrasion amount as in other samples before 500,000 sheets of paper was fed, but that the abrasive amount suddenly increased when 1,000,000 sheets of paper was fed. It is assumed from this result that in a sample having a large Cy as was described above, the surface layer caused a change during a durability test, and accordingly the abrasive amount increased.

From a result of having compared a Sample 4 (Example 3) with a Sample 5 (Comparative example 2), it is understood that when the Cy is 7.0 or less, the abrasive amount is 1.4 or less.

From the above described result, it was found that a sample having a composition ratio of an aluminum atom to a zinc atom in a Cy range of 3.0 or more but 7.0 or less does not cause an image blur due to a fine uplift of a film, and is superior in abrasion resistance as well.

Examples 4 to 6 and Comparative Examples 5 and 6

An electrophotographic photosensitive member was produced similarly to that of Example 1, except that a used conductive substrate was a cylinder which was made from aluminum, had the outer diameter of 84 mm, the length of 381 mm and the wall thickness of 3 mm, and had the surface mirror-finished, and that a surface layer was formed in conditions shown in Table 5 and Table 6. The surface layer was formed by using a target in which the area ratio % of zinc oxide with respect to the whole area of the target was kept at 20.0, and by adjusting the content of an oxygen atom through changing the flow rate of oxygen gas of a reactive gas.

TABLE 5

| | Surface layer |
|---|---|
| Target (area ratio of AlO:ZnO) | 20.0 |
| Flow rate of gas | |
| Ar [ml/min (normal)] | 200 |
| $O_2$ [ml/min (normal)] | Table 6 |
| Pressure [Pa] | 0.30 |
| Electric power [w] | 2000 |
| Substrate temperature [° C.] | 100 |
| Film thickness [μm] | 0.8 |

TABLE 6

| | Sample 8 Comparative example 5 | Sample 9 Example 4 | Sample 10 Example 5 | Sample 11 Example 6 | Sample 12 Comparative example 6 |
|---|---|---|---|---|---|
| Area ratio of AlO:ZnO | 20.0 | 20.0 | 20.0 | 20.0 | 20.0 |
| $O_2$ [ml/min (normal)] | 2.3 | 2.7 | 3.6 | 5.6 | 6.8 |
| Cy | 5.0 | 4.9 | 5.1 | 4.9 | 5.0 |
| C z | 1.02 | 1.06 | 1.12 | 1.20 | 1.23 |

An image was formed by using each of the obtained samples 8 to 12 and was evaluated similarly to that in Example 1. The results are shown in Table 7.

TABLE 7

| | Sample 8 Comparative example 5 | Sample 9 Example 4 | Sample 10 Example 5 | Sample 11 Example 6 | Sample 12 Comparative example 6 |
|---|---|---|---|---|---|
| Cz | 1.02 | 1.07 | 1.12 | 1.20 | 1.23 |
| Chargeability | 1.03 | 0.98 | 0.98 | 0.98 | 1.05 |
| Light sensitivity | 1.03 | 1.00 | 0.98 | 1.02 | 0.97 |
| Residual potential | 1.04 | 0.96 | 1.36 | 1.20 | 1.05 |

TABLE 7-continued

| | Sample 8 Comparative example 5 | Sample 9 Example 4 | Sample 10 Example 5 | Sample 11 Example 6 | Sample 12 Comparative example 6 |
|---|---|---|---|---|---|
| Image blur | 1.06 | 1.07 | 0.95 | 1.00 | 0.95 |
| Ghost | 4.29 | 1.71 | 1.00 | 0.86 | 1.29 |
| Abrasion amount (500,000 sheets) | 1.06 | 0.98 | 1.06 | 1.03 | 0.96 |
| Abrasion amount (1,000,000 sheets) | 1.03 | 1.03 | 0.99 | 0.98 | 0.98 |
| Melt-adhesion | A | A | A | A | C |

In the table, values of a chargeability, light sensitivity, a residual potential, an image blur, a ghost, an abrasion amount (500,000 sheets) and an abrasion amount (1,000,000 sheets) are relative values based on the assumption of considering respective values in Example 2 as 1.00.

A sample 8 having the Cz of 1.02 showed an aggravation of the ghost. It is understood from a sample 8 and a sample 9 that when the sample has the Cz in a range of 1.05 or more, the ghost is evaluated as 2.50 or less. A sample 12 showed the melt-adhesion. In this way, it is understood that when the content of an oxygen atom increases, the sample tends to suddenly cause the melt-adhesion, but that when the Cz is 1.20 or less, the sample is inhibited from causing the melt-adhesion.

It is understood from the results of Examples 1 to 6 and Comparative examples 1 to 6 that an electrophotographic photosensitive member which has a surface layer having such a composition ratio as to simultaneously satisfy Expression (1) and Expression (2) is superior in adhesiveness, durability and image characteristics.

Examples 7 to 14

Electrophotographic photosensitive members (samples 13 to 19) were produced by using a cylinder which was made from aluminum, had the outer diameter of 84 mm, the length of 381 mm and the wall thickness of 3 mm, and had the surface mirror-finished, as a conductive substrate, and by forming a lower electric-charge injection preventing layer, a photoconductive layer, an intermediate layer and a surface layer thereon. The samples 13 to 19 (Examples 7 to 13) were produced by adopting an a-SiN layer as the intermediate layer in which the content of a nitrogen atom with respect to a silicon atom in the intermediate layer was changed by adjusting the flow rate of N2, and a sample 20 (Example 14) was produced for comparison, which had not the intermediate layer formed therein. The lower electric-charge injection preventing layer, the photoconductive layer and the intermediate layer were formed with the use of the plasma CVD apparatus illustrated in FIG. 4 in conditions shown in Table 8 and Table 9. Here, the high-frequency power uses a frequency of 13.56 MHz. Afterwards, the surface layer was formed similarly to that of Example 2.

TABLE 8

| | Lower electric-charge injection preventing layer | Photoconductive layer | Intermediate layer |
|---|---|---|---|
| Flow rate of gas | | | |
| $SiH_4$ [ml/min (normal)] | 200 | 200 | 50 |
| $H_2$ [ml/min (normal)] | 650 | 650 | 100 |
| $B_2H_6$ (ppm) (with respect to $SiH_4$) | 1000 | 1.5 | |
| NO [ml/min (normal)] | 10 | | |
| $N_2$ [ml/min (normal)] | | | Table 9 |
| Pressure [Pa] | 80 | 75 | 60 |
| High-frequency power [w] | 200 | 800 | 600 |
| Substrate temperature [° C.] | 270 | 270 | 240 |
| Film thickness [μm] | 3 | 30 | 0.1 |

TABLE 9

| | Sample 13 | Sample 14 | Sample 15 | Sample 16 | Sample 17 | Sample 18 | Sample 19 |
|---|---|---|---|---|---|---|---|
| Flow rate of $N_2$ [ml/min (normal)] | 10 | 14 | 50 | 130 | 250 | 320 | 400 |
| N content (atom %) | 3.5 | 4.5 | 13 | 30 | 50 | 57 | 62 |

In the table, the value of the N content was obtained as a result of preparing a sample in which the intermediate layer was formed on a photoconductive layer so as to have a thickness of approximately 1 μm in the same conditions of each sample without forming a surface layer as the sample for measuring the N content, and then measuring the N content by using the sample for measuring the N content with ESCA in a similar method to the above described method. Further, the value of the N content is shown by the content ratio (unit: atom %) of the nitrogen atom with respect to all atoms in the intermediate layer.

An image was formed by using each of the obtained samples 13 to 19 and was evaluated similarly to that in Example 1. The results are shown in Table 10. In this case, an image blur was evaluated only in an initial evaluation.

TABLE 10

| | Sample 13 Example 7 | Sample 14 Example 8 | Sample 15 Example 9 | Sample 16 Example 10 | Sample 17 Example 11 | Sample 18 Example 12 | Sample 19 Example 13 | Sample 20 Example 14 |
|---|---|---|---|---|---|---|---|---|
| N content (atom %) | 3.5 | 4.5 | 13 | 30 | 50 | 57 | 62 | — |
| Electrification performance | 0.98 | 1.04 | 1.04 | 0.96 | 1.05 | 0.97 | 0.95 | 1.06 |
| Light sensitivity | 0.95 | 0.94 | 0.91 | 0.89 | 0.90 | 0.93 | 0.94 | 1.03 |
| Residual potential | 1.04 | 1.34 | 0.93 | 1.04 | 0.94 | 1.20 | 1.00 | 0.98 |
| Image blur | 0.95 | 1.48 | 1.25 | 1.00 | 1.06 | 0.92 | 1.20 | 1.04 |
| Ghost | 1.00 | 1.03 | 0.95 | 1.08 | 1.06 | 0.98 | 1.03 | 0.96 |

Numeric values in the table are relative values based on the assumption of considering respective values of the electrophotographic photosensitive member in Example 2 as 1.00.

Any of electrophotographic photosensitive members (samples 13 to 19) on which an intermediate layer was formed showed better sensitivity than the electrophotographic photosensitive member (sample 20) on which the intermediate layer was not formed. A sample particularly having a light sensitivity of 0.92 or less is assumed to show sufficient light sensitivity even though the printing speed of the electrophotographic apparatus used for evaluation was increased by approximately 20%. From the results of samples 14 and 15 and samples 17 and 18, a sample in a region having a light sensitivity of 0.92 or less is estimated to be a sample having an N content in a range of approximately 10 atom % or more and 55 atom % or less.

Examples 15 to 21

Electrophotographic photosensitive members (samples 21 to 27) were formed by forming a lower electric-charge injection preventing layer and a photoconductive layer in conditions shown in Table 11; by forming an intermediate layer in conditions shown in Table 11 through adopting an a-SiC layer as the intermediate layer and changing the content of a carbon atom with respect to a silicon atom in the intermediate layer by adjusting the flow rate of $CH_4$ as shown in Table 12; and by forming other parts in a similar method to that in Example 7.

TABLE 11

| | Lower electric-charge injection preventing layer | Photoconductive layer | Intermediate layer |
|---|---|---|---|
| Flow rate of gas | | | |
| $SiH_4$ [ml/min (normal)] | 200 | 200 | 50 |
| $H_2$ [ml/min (normal)] | 850 | 650 | 100 |
| $B_2H_6$ (ppm) (with respect to $SiH_4$) | 1000 | 1.5 | |
| NO [ml/min (normal)] | 10 | | |
| $CH_4$ [ml/min (normal)] | | | Table 12 |
| Pressure [Pa] | 80 | 75 | 60 |
| High-frequency power [w] | 200 | 800 | 600 |
| Substrate temperature [° C.] | 250 | 270 | 240 |
| Film thickness [μm] | 3 | 30 | 0.1 |

TABLE 12

| | Sample 21 | Sample 22 | Sample 23 | Sample 24 | Sample 25 | Sample 26 | Sample 27 |
|---|---|---|---|---|---|---|---|
| Flow rate of $CH_4$ [ml/min (normal)] | 10 | 14 | 50 | 130 | 280 | 400 | 600 |
| C content (atom %) | 3.5 | 6.3 | 18 | 43 | 85 | 106 | 121 |

In the table, the value of the C content was obtained as a result of preparing a sample in which the intermediate layer was formed on a photoconductive layer so as to have a thickness of approximately 1 μm in the same conditions of each sample without forming a surface layer as the sample for measuring the C content, and then measuring the C content by using the sample for measuring the C content with ESCA in a similar method to the above described method. Further, the value of the C content is shown by the content ratio (unit: atom %) of the carbon atom with respect to all atoms in the intermediate layer.

An image was formed by using each of the obtained samples 21 to 27 and was evaluated similarly to that in Example 1. The results are shown in Table 13. In this case, an image blur was evaluated only in an initial evaluation.

TABLE 13

| | Sample 21 Example 15 | Sample 22 Example 16 | Sample 23 Example 17 | Sample 24 Example 18 | Sample 25 Example 19 | Sample 26 Example 20 | Sample 27 Example 21 | Sample 20 Example 14 |
|---|---|---|---|---|---|---|---|---|
| C content (atom %) | 3.5 | 6.3 | 18 | 43 | 85 | 106 | 121 | — |
| Electrification performance | 0.98 | 1.04 | 1.04 | 0.96 | 1.05 | 0.97 | 0.95 | 1.06 |
| Light sensitivity | 0.94 | 0.93 | 0.90 | 0.89 | 0.89 | 0.93 | 0.95 | 1.03 |
| Residual potential | 1.04 | 1.34 | 0.93 | 1.04 | 0.94 | 1.20 | 1.00 | 0.98 |
| Image blur | 0.95 | 1.06 | 1.25 | 1.00 | 1.23 | 0.92 | 1.46 | 1.04 |
| Ghost | 1.46 | 1.03 | 0.95 | 1.08 | 1.32 | 0.98 | 1.03 | 0.96 |

Numeric values in the table are relative values based on the assumption of considering respective values of the electrophotographic photosensitive member in Example 2 as 1.00.

Any of electrophotographic photosensitive members (samples 21 to 27) on which an intermediate layer was formed showed better sensitivity than the electrophotographic photosensitive member (sample 20) on which the intermediate layer was not formed. From the results of samples 22 and 23 and samples 25 and 26, a sample in a region having a light sensitivity of 0.92 or less is estimated to be a sample having a C content in a range of approximately 10 atom % or more but 100 atom % or less.

Examples 22 to 24

Electrophotographic photosensitive members (samples 28 to 30) were produced by forming a lower electric-charge injection preventing layer and a photoconductive layer in conditions shown in Table 14; by forming an intermediate layer in conditions shown in Table 15 through using magnesium fluoride ($MgF_2$), magnesium oxide (MgO) and lanthanum fluoride ($LaO_3$) respectively with the use of a sputtering apparatus illustrated in FIG. 5; and by forming other parts in a similar method to that in Example 7.

TABLE 14

| | Lower electric-charge injection preventing layer | Photoconductive layers |
|---|---|---|
| Flow rate of gas | | |
| $SiH_4$ [ml/min (normal)] | 200 | 200 |
| $H_2$ [ml/min (normal)] | 650 | 650 |
| $B_2H_6$ (ppm) (with respect to $SiH_4$) | 1000 | 1.5 |
| NO [ml/min (normal)] | 10 | |
| Pressure [Pa] | 80 | 75 |
| High-frequency power [w] | 200 | 800 |
| Substrate temperature [° C.] | 270 | 270 |
| Film thickness [μm] | 3 | 30 |

TABLE 15

| | Intermediate layer | | |
|---|---|---|---|
| | Sample 28 | Sample 29 | Sample 30 |
| Target | $MgF_2$ | MgO | $LaF_3$ |
| Flow rate of gas | | | |
| Ar [ml/min (normal)] | 75 | 75 | 75 |
| $F_2$ [ml/min (normal)] | 2.0 | | 2.3 |
| $O_2$ [ml/min (normal)] | | 1.5 | |
| Pressure [Pa] | 0.3 | 0.3 | 0.3 |
| Electric power [w] | 1000 | 1000 | 1000 |
| Substrate temperature [° C.] | 25 | 25 | 25 |
| Film thickness [μm] | 0.1 | 0.1 | 0.1 |
| F or O Content (atom %) | 67.2 | 50.8 | 74.4 |

In the table, the value of the F or O content was obtained as a result of preparing a sample in which the intermediate layer was formed on a photoconductive layer so as to have a thickness of approximately 1 μm in the same conditions of each sample without forming a surface layer as the sample for measuring the F or O content, and then measuring the F or O content by using the sample for measuring the F or O content with ESCA in a similar method to the above described method. Further, the value of the F or O content is shown by the content ratio (unit: atom %) of the fluorine atom (samples 28 and 30) or the oxygen atom (sample 29) with respect to all atoms in the intermediate layer.

An image was formed by using each of the obtained samples 28 to 30 and was evaluated similarly to that in Example 1. The results are shown in Table 16. In this case, an image blur was evaluated only in an initial evaluation.

TABLE 16

| | Sample 28 Example 22 | Sample 29 Example 23 | Sample 30 Example 24 |
|---|---|---|---|
| Chargeability | 1.05 | 1.04 | 0.97 |
| Light sensitivity | 0.89 | 0.91 | 0.87 |
| Residual potential | 0.93 | 1.20 | 1.34 |
| Image blur | 1.00 | 1.20 | 1.45 |
| Ghost | 1.03 | 0.98 | 0.95 |

Numeric values in the table are relative values based on the assumption of considering respective values of the electrophotographic photosensitive member in Example 2 as 1.00.

Any of electrophotographic photosensitive members (samples 28 to 30) on which an intermediate layer was formed showed better sensitivity than the electrophotographic photosensitive member (sample 20) on which the intermediate layer was not formed. In this way, it was found that an effect of inhibiting a diffusion layer from being formed is obtained by using a metal oxide film or a metal fluoride film which do not substantially contain an aluminum atom, as an intermediate layer. It can be expected that even the metal oxide film, the metal nitride film and the metal fluoride film of a metal other than magnesium and lanthanum will show a similar effect as long as the film does not include the aluminum atom.

While the present invention has been described with reference to examples, it is to be understood that the invention is not limited to the disclosed examples. The scope of the following claims is to be accorded the broadest interpretation so as to encompass all such modifications and equivalent structures and functions.

This application claims the benefit of Japanese Patent Application No. 2008-191982, filed Jul. 25, 2008, which is hereby incorporated by reference herein in its entirety.

What is claimed is:

1. An electrophotographic photosensitive member comprising a conductive substrate, and a photoconductive layer and a surface layer formed in this order on the conductive substrate, wherein the photoconductive layer is an amorphous layer which contains a silicon atom as a main component, and the surface layer contains an aluminum atom, a zinc atom and an oxygen atom so as to satisfy Expression (1) and Expression (2):

$$3.0 \leqq 100\{y/(x+y)\} \leqq 7.0 \quad (1), \text{ and}$$

$$1.05 \leqq z/(1.50x+y) \leqq 1.20 \quad (2)$$

wherein x represents atom % of the aluminum atom contained in the surface layer; y represents atom % of the zinc atom contained in the surface layer; and z represents atom % of the oxygen atom contained in the surface layer.

2. The electrophotographic photosensitive member according to claim 1, further comprising an intermediate layer between the photoconductive layer and the surface layer, wherein the intermediate layer is an amorphous layer which contains the silicon atom and a nitrogen atom as a main component or an amorphous layer which contains the silicon atom and a carbon atom as a main component.

3. The electrophotographic photosensitive member according to claim 1, further comprising an intermediate layer which does not contain the aluminum atom between the photoconductive layer and the surface layer, wherein the intermediate layer contains at least one compound selected from the group consisting of a metal oxide, a metal nitride and a metal fluoride.

4. An electrophotographic apparatus having the electrophotographic photosensitive member according to claim 1.

* * * * *